US008678557B2

(12) United States Patent
Fang et al.

(10) Patent No.: US 8,678,557 B2
(45) Date of Patent: Mar. 25, 2014

(54) SUBSTRATE STRUCTURE FOR EJECTION CHIP AND METHOD FOR FABRICATING SUBSTRATE STRUCTURE

(75) Inventors: Jiandong Fang, Lexington, KY (US); James Mrvos, Lexington, KY (US)

(73) Assignee: Funai Electric Co., Ltd., Osaka (JP)

( * ) Notice: Subject to any disclaimer, the term of this patent is extended or adjusted under 35 U.S.C. 154(b) by 178 days.

(21) Appl. No.: 13/187,755

(22) Filed: Jul. 21, 2011

(65) Prior Publication Data

US 2013/0021405 A1 Jan. 24, 2013

(51) Int. Cl.
*B41J 2/05* (2006.01)

(52) U.S. Cl.
USPC ..... 347/65; 347/63; 347/56

(58) Field of Classification Search
USPC ..... 347/20, 44, 47, 56, 61–65, 67
See application file for complete search history.

(56) References Cited

U.S. PATENT DOCUMENTS 6,627,467 B2 * 9/2003 Haluzak et al. ..... 347/20

* cited by examiner

*Primary Examiner* — Juanita D Jackson
(74) *Attorney, Agent, or Firm* — Amster, Rothstein & Ebenstein LLP

(57) ABSTRACT

Disclosed is a substrate structure for an ejection chip that includes a first substrate layer, a second substrate layer disposed beneath the first substrate layer, and an intermediate layer configured between the first substrate layer and the second substrate layer. The substrate structure also includes a plurality of fluid channels configured within the second substrate layer. Further, the substrate structure includes a plurality of fluid ports configured within the first substrate layer. At least one fluid port of the plurality of fluid ports is configured in alignment with a corresponding fluid channel of the plurality of fluid channels. Furthermore, the substrate structure includes a plurality of slots configured within the intermediate layer such that the at least one fluid port is in fluid communication with the corresponding fluid channel. Further disclosed is a method for fabricating the substrate structure and an ejection chip employing the substrate structure.

8 Claims, 5 Drawing Sheets

SUBSTRATE STRUCTURE FOR EJECTION CHIP AND METHOD FOR FABRICATING SUBSTRATE STRUCTURE

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

I. Field of the Disclosure

The present disclosure relates generally to ejection chips for printers, and more particularly, to a substrate structure for an ejection chip for a printer.

II. Description of the Related Art

A typical ejection chip (heater chip) for a printer, such as an inkjet printer, includes a substrate (silicon wafer) carrying at least one fluid ejection element thereupon; a flow feature layer configured over the substrate; and a nozzle plate configured over the flow feature layer. The flow feature layer includes a plurality of flow features (firing chambers and fluid channels), and the nozzle plate includes a plurality of nozzles.

Narrower ejection chips that are preferred for pagewide ejection devices, i.e., inkjet printheads, require a configuration as depicted in FIGS. 1-3. FIG. 1 depicts a partial perspective view of a conventional narrow ejection chip 100 (hereinafter referred to as "ejection chip 100") without any flow feature layer and nozzle plate.

The ejection chip 100 is a 1-4 millimeters (mm) wide printhead chip that includes a substrate 110 (silicon wafer), and a plurality of fluid channels, such as a fluid channel 122, a fluid channel 124, a fluid channel 126, and a fluid channel 128, configured within the substrate 110. Further, the ejection chip 100 includes a plurality of fluid ports configured within a top portion 112 of the substrate 110, and coupled with a corresponding fluid channel of the plurality of fluid channels. Specifically, the ejection chip 100 includes a plurality of fluid ports 132 fluidly coupled with the fluid channel 122, a plurality of fluid ports 134 fluidly coupled with the fluid channel 124, a plurality of fluid ports 136 fluidly coupled with the fluid channel 126, and a plurality of fluid ports 138 fluidly coupled with the fluid channel 128. Accordingly, as depicted in FIG. 1, the fluid ports 132, 134, 136, and 138 are provided in the form of arrays at the top portion 112 of the substrate 110 to feed individual firing chambers (not shown) of a nozzle plate layer (not shown) configured over the substrate 110. Specifically, an individual firing chamber is fed by a single fluid port from the fluid ports 132, 134, 136, and 138.

FIG. 2 depicts a simulated view of fluidic path corresponding to the ejection chip 100. The fluidic path is contributed by fluids (inks), such as fluids 142, 144, 146 and 148 that feed respective fluid channels 122, 124, 126, and 128, and the respective fluid ports 132, 134, 136, and 138. Further, the fluid 142 may be a cyan colored fluid, the fluid 144 may be a yellow colored fluid, the fluid 146 may be a magenta colored fluid, and the fluid 148 may be a black colored fluid.

FIG. 3 depicts a bottom perspective (longitudinal) view of the ejection chip 100. Specifically, FIG. 3 depicts a bottom view of fluid paths in the ejection chip 100 with a plurality of ports configured at a bottom portion 114 of the substrate 110 (as depicted in FIG. 1) and fluidly coupled with corresponding fluid channels of the plurality of fluid channels. More specifically, the ejection chip 100 includes a plurality of supply ports 152 fluidly coupled with the fluid channel 122 to carry the fluid 142, a plurality of supply ports 154 fluidly coupled with the fluid channel 124 to carry the fluid 144, a plurality of supply ports 156 fluidly coupled with the fluid channel 126 to carry the fluid 146, and a plurality of supply ports 158 fluidly coupled with the fluid channel 128 to carry the fluid 148. Each port of the supply ports 152 is spaced apart from an adjacent port of the supply ports 152 by a distance of 300-800 microns (μm). Similarly, each port of the supply ports 154, each port of the supply ports 156, and each port of the supply ports 158, is separated by a distance of about 300-800 μm from a respective adjacent port of the supply ports 154, 156, and 158. The spacing among the supply ports 152, 154, 156, and 158 facilitates an easy adhesive dispense to achieve bonding without clogging the supply ports 152, 154, 156, and 158. Further, the each port of the supply ports 152, 154, 156, and 158 is fluidly coupled with a corresponding port of a fluid supply structure/reservoir (not shown) configured underneath the substrate 110, in order to provide a port-to-port connection.

To achieve a narrow structure, such as that of the ejection chip 100, and more particularly, the dimensions of the fluid ports 132, 134, 136, and 138 that are critical for fluid flow resistance to each firing chamber, various methods of fabrication have been employed till date.

FIG. 4 depicts a partial cross-sectional view of a narrow ejection chip 200 (hereinafter referred to as "ejection chip 200") formed by a conventional fabrication method employing Deep Reactive Ion Etching (DRIE) technique to form a plurality of fluid channels, such as a fluid channel 222 and a fluid channel 224; and to form a plurality of fluid ports, such as a fluid port 232 and a fluid port 234, within a substrate 210 (silicon wafer). Specifically, DRIE technique is used for etching the substrate 210 from a top portion 212 (device side) thereof to form the fluid ports 232 and 234. Further, the fluid ports 232 and 234 may be formed using a control of etching time with an assumption of a fixed etching rate. The fluid ports 232 and 234 may then be filled with a sacrificial material and the substrate 210 may then be ground from backside thereof up to a certain thickness. Thereafter, DRIE technique is used for etching the substrate 210 from a bottom portion 214 thereof to form the fluid channels 222 and 224 fluidly coupled with the fluid ports 232 and 234, respectively.

The ejection chip 200 further includes a flow feature layer 260 configured over the substrate 210. The flow feature layer 260 includes a plurality of flow features (fluid channels and firing chambers), such as a flow feature 262 and a flow feature 264. Each of the flow features 262 and 264 is fluidly coupled to a corresponding port, such as the fluid ports 232 and 234. Accordingly, the fluid ports 232 and 234 are adapted to supply fluids to each respective firing chamber. Furthermore, the ejection chip 200 includes a nozzle plate 270 configured over the flow feature layer 260. The nozzle plate 270 includes a plurality of nozzles, such as a nozzle 272 and a nozzle 274. Each of the nozzles 272 and 274 is fluidly coupled with one or more respective flow features of the plurality of flow features. Specifically, the nozzle 272 is fluidly coupled with the flow feature 262, and the nozzle 274 is fluidly coupled with the flow feature 264.

Similarly, FIG. 5 depicts a partial cross-sectional view of a narrow ejection chip 300 (hereinafter referred to as "ejection chip 300") formed by another conventional fabrication method that employs undercut etching (chemical etching) technique for etching a top portion 312 of a substrate 310 to form trapezoidal fluid ports (not numbered) as an extension of fluid channels, such as a fluid channel 322 and a fluid channel 324 for reduced flow resistance. Accordingly, the aforementioned method utilizes a single chemical etching process to form the trapezoidal fluid ports.

The ejection chip 300 further includes a flow feature layer 360 configured over the substrate 310. The flow feature layer 360 includes a plurality of flow features (fluid channels and firing chambers), such as a flow feature 362 and a flow feature 364. Each of the flow features 362 and 364 is fluidly coupled to a corresponding port of the trapezoidal fluid ports. Furthermore, the ejection chip 300 includes a nozzle plate 370 configured over the flow feature layer 360. The nozzle plate 370 includes a plurality of nozzles, such as a nozzle 372 and a nozzle 374. Each of the nozzles 372 and 374 is fluidly coupled with one or more respective flow features of the plurality of flow features. Specifically, the nozzle 372 is fluidly coupled with the flow feature 362, and the nozzle 374 is fluidly coupled with the flow feature 364.

However, the aforementioned conventional fabrication methods are incapable of producing uniform and very thin top membrane (less than about 100 μm) at fluid channels. Specifically, the grinding process utilized for grinding a substrate, such as the substrate 210, has a tolerance ranging from about 5 μm to about 10 μm in thickness. Further, DRIE technique and chemical etching technique are associated with an inconsistent etching rate, i.e., there is a certain etching thickness tolerance. Furthermore, fluid channels etched in a substrate may not achieve a high uniformity across either a 6-inch or an 8-inch silicon wafer, due to etching rate non-uniformity caused by plasma density or chemical etchant concentration non-uniformity. Accordingly, top fluid ports in such a substrate have non-uniform thickness across the substrate. The thickness non-uniformity results in flow resistance difference among the fluid ports to firing chambers that leads to quality reduction of inkjet printing. In addition, a DRIE process stopped on a substrate has a curved etching front due to plasma loading effect. Moreover, the need to have sacrificial materials to be filled in fluid ports prior to grinding the substrate from respective backside and etch bottom portion thereof, may lead to inconsistency in the substrate while fabricating an ejection chip.

Accordingly, there persists a need for a substrate structure for an ejection chip and a method of fabricating the substrate structure that provides uniform thickness of a top membrane above fluid channels across the substrate structure while having identical fluidic resistance through fluid ports feeding various firing chambers.

SUMMARY OF THE DISCLOSURE

In view of the foregoing disadvantages inherent in the prior art, the general purpose of the present disclosure is to provide a substrate structure for an ejection chip, an ejection chip employing the substrate structure, and a method of fabricating the substrate structure, by including all the advantages of the prior art, and overcoming the drawbacks inherent therein.

In one aspect, the present disclosure provides a substrate structure for an ejection chip. The substrate structure includes a first substrate layer, a second substrate layer disposed beneath the first substrate layer, and an intermediate layer configured between the first substrate layer and the second substrate layer. The intermediate layer is an insulating layer. The substrate structure further includes a plurality of fluid channels configured within the second substrate layer. Furthermore, the substrate structure includes a plurality of fluid ports configured within the first substrate layer. At least one fluid port of the plurality of fluid ports is configured in alignment with a corresponding fluid channel of the plurality of fluid channels. Moreover, the substrate structure includes a plurality of slots configured within the intermediate layer such that the at least one fluid port of the plurality of fluid ports is in fluid communication with the corresponding fluid channel of the plurality of fluid channels.

In another aspect, the present disclosure provides an ejection chip for an inkjet printer. The ejection chip includes a substrate structure. The substrate structure includes a first substrate layer, a second substrate layer disposed beneath the first substrate layer, and an intermediate layer configured between the first substrate layer and the second substrate layer. The intermediate layer is an insulating layer. The substrate structure further includes a plurality of fluid channels configured within the second substrate layer. Furthermore, the substrate structure includes a plurality of fluid ports configured within the first substrate layer. At least one fluid port of the plurality of fluid ports is configured in alignment with a corresponding fluid channel of the plurality of fluid channels. Also, the substrate structure includes a plurality of slots configured within the intermediate layer such that the at least one fluid port of the plurality of fluid ports is in fluid communication with the corresponding fluid channel of the plurality of fluid channels.

The ejection chip also includes at least one fluid ejection element carried by the substrate structure and adapted to eject a fluid therefrom. Additionally, the ejection chip includes a flow feature layer configured over the substrate structure. The flow feature layer includes a plurality of flow features. Each flow feature of the plurality of flow features is configured in fluid communication with at least one corresponding port of the plurality of ports of the first substrate layer. Moreover, the ejection chip includes a nozzle plate configured over the flow feature layer. The nozzle plate includes a plurality of nozzles. Each nozzle of the plurality of nozzles is configured in fluid communication with at least one corresponding flow feature of the plurality of flow features of the flow feature layer.

In yet another aspect, the present disclosure provides a method for fabricating a substrate structure of an ejection chip. The method includes forming a silicon-on-insulator structure. The silicon-on-insulator structure includes a first substrate layer, a second substrate layer disposed beneath the first substrate layer, and an intermediate layer configured between the first substrate layer and the second substrate layer. The intermediate layer is an insulating layer. The method further includes etching the second substrate layer from a bottom portion thereof up to the intermediate layer to form a plurality of fluid channels within the second substrate layer. Furthermore, the method includes etching the first substrate layer from a top portion thereof up to the intermediate layer to form a plurality of fluid ports within the first substrate layer such that at least one fluid port of the plurality of fluid ports is configured in alignment with a corresponding fluid channel of the plurality of fluid channels. In addition, the method includes etching the intermediate layer through at least one of the plurality of fluid ports and the plurality of fluid channels to form a plurality of slots within the intermediate layer such that the at least one fluid port of the plurality of fluid ports is in fluid communication with the corresponding fluid channel of the plurality of fluid channels.

BRIEF DESCRIPTION OF THE DRAWINGS

The above-mentioned and other features and advantages of the present disclosure, and the manner of attaining them, will become more apparent and will be better understood by reference to the following description of embodiments of the disclosure taken in conjunction with the accompanying drawings, wherein.

DETAILED DESCRIPTION

It is to be understood that various omissions and substitutions of equivalents are contemplated as circumstances may suggest or render expedient, but these are intended to cover the application or implementation without departing from the spirit or scope of the claims of the present disclosure. It is to be understood that the present disclosure is not limited in its application to the details of components set forth in the following description. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of at least one of the referenced item.

In one aspect, the present disclosure provides a substrate structure for an ejection chip (heater chip) that may be utilized in an ejection device (printhead) of printers, such as inkjet printers. The substrate structure of the present disclosure is explained in conjunction with FIG. 6.

Figure 1:
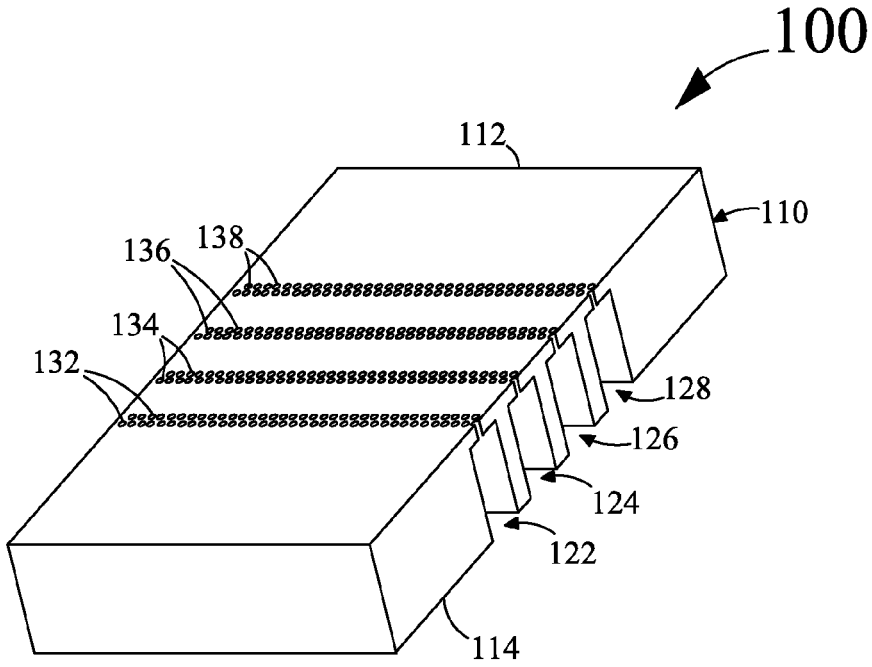
Figure 1 (Prior art)
FIG. 1 depicts a partial perspective view of a conventional narrow ejection chip without any flow feature layer and nozzle plate.
Figure 2:
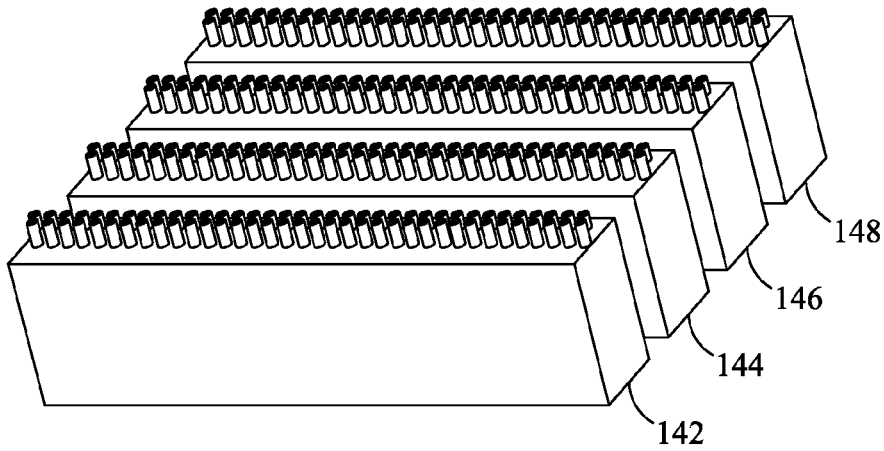
Figure 2 (Prior art)
FIG. 2 depicts a simulated view of fluidic path corresponding to the conventional narrow ejection chip of FIG. 1.
Figure 3:
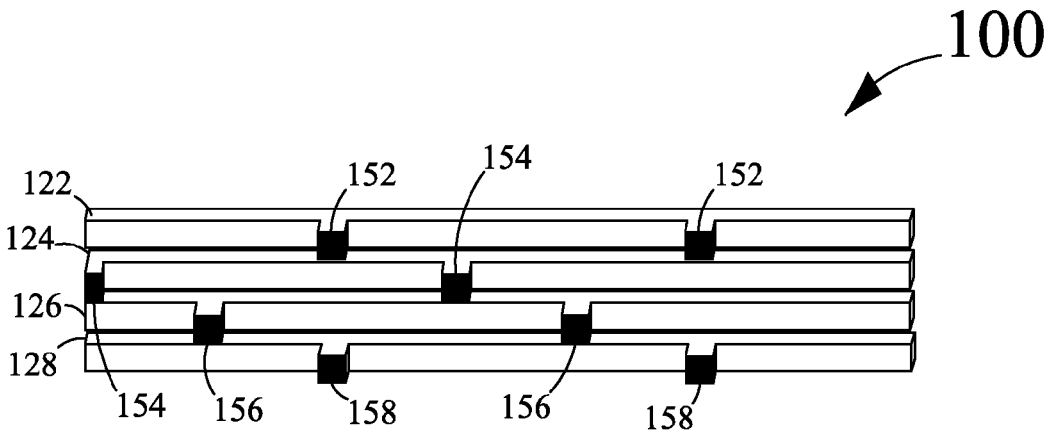
Figure 3 (Prior art)
FIG. 3 depicts a bottom perspective (longitudinal) view of the conventional narrow ejection chip of FIG. 1.
Figure 4:
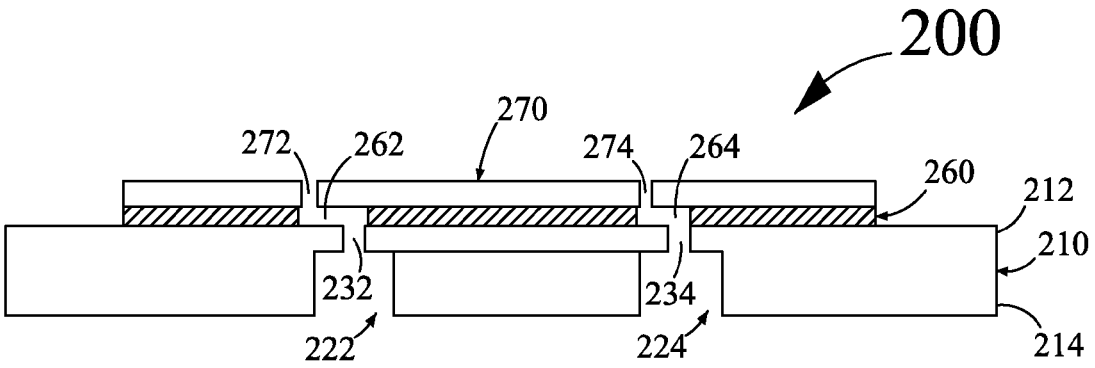
Figure 4 (Prior art)
FIG. 4 depicts a partial cross-sectional view of a narrow ejection chip formed by a conventional fabrication method.
Figure 5:
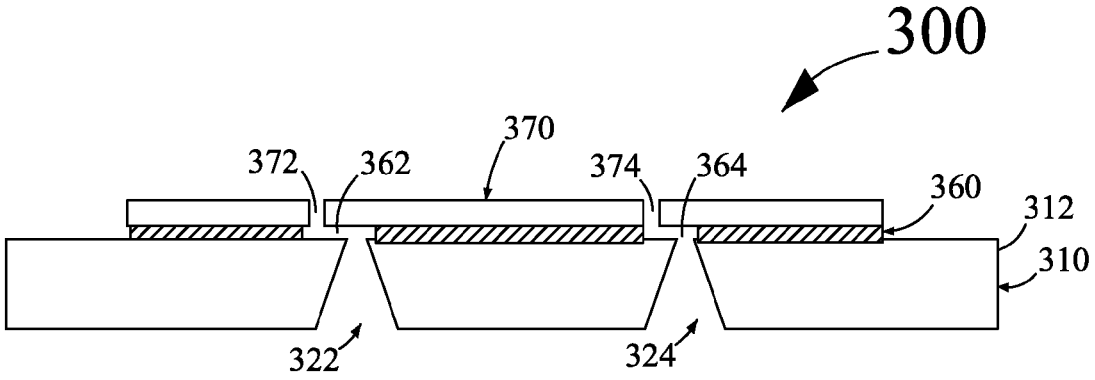
Figure 5 (Prior art)
FIG. 5 depicts a partial cross-sectional view of a narrow ejection chip formed by another conventional fabrication method.
Figure 6:
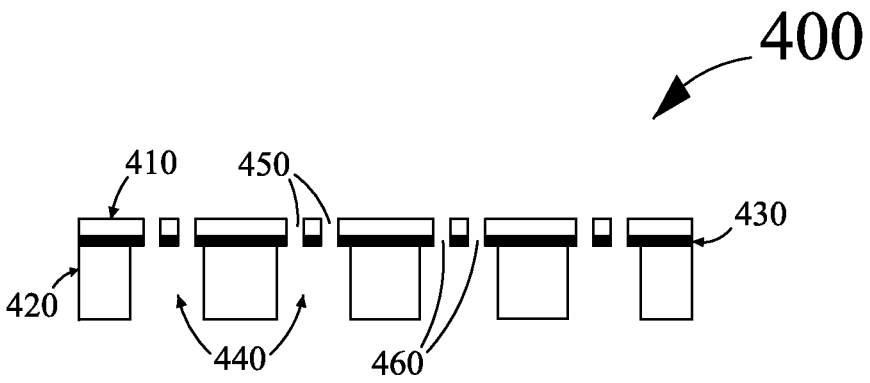
FIG. 6 depicts a partial cross-sectional view of a substrate structure for an ejection chip, in accordance with an embodiment of the present disclosure.

FIG. 6 depicts a partial cross-sectional view of a substrate structure 400 for an ejection chip. The substrate structure 400 includes a first substrate layer 410 (device side), and a second substrate layer 420 (handle side) disposed beneath the first substrate layer 410. The first substrate layer 410 and the second substrate layer 420 are composed of silicon. It will be evident that the first substrate layer 410 and the second substrate layer 420 may be composed of any other material as known in the art. In the present embodiment, the first substrate layer 410 has a thickness ranging from about 10 microns (μm) to about 80 μm, and more specifically, 30 μm. Further, the second substrate layer 420 has a thickness ranging from about 100 μm to about 800 μm. However, dimensions of the first substrate layer 410 and the second substrate layer 420 should not be considered as a limitation to the present disclosure.

The substrate structure 400 further includes an intermediate layer 430 configured between the first substrate layer 410 and the second substrate layer 420. The intermediate layer 430 is an insulating layer, and is composed of silicon oxide. Accordingly, the intermediate layer 430 is an oxide layer buried between the first substrate layer 410 and the second substrate layer 420. It will be evident that the intermediate layer 430 may be composed of any other insulating material as known in the art. In the present embodiment, the intermediate layer 430 has a thickness ranging from about 0.5 μm to about 5 μm. However, dimension of the intermediate layer 430 should not be considered as a limitation to the present disclosure.

The arrangement of the first substrate layer 410, the second substrate layer 420 and the intermediate layer 430 depicts a silicon-on-insulator (SOI) structure (wafer). The SOI structure may be customized with different thicknesses of the first substrate layer 410, the second substrate layer 420, and the intermediate layer 430 depending on a manufacturer's requirements.

Furthermore, the substrate structure 400 includes a plurality of fluid channels 440 configured within the second substrate layer 420. Specifically, the fluid channels 440 are configured across the thickness of the second substrate layer 420. Further, each fluid channel of the fluid channels 440 is configured to have a rectangular shape as depicted in FIG. 6. However, it will be evident that the each fluid channel may be configured to have any shape and dimension thereof based on a manufacturer's preference.

Moreover, the substrate structure 400 includes a plurality of fluid ports 450 configured within the first substrate layer 410. At least one fluid port of the fluid ports 450 is configured in alignment with a corresponding fluid channel of the fluid channels 440. For the purpose of this description, only two fluid ports of the fluid ports 450 are configured in alignment with a corresponding fluid channel of the fluid channels 440. As depicted in FIG. 6, each fluid port of the fluid ports 450 is configured to have the shape of a square. However, it will be evident that the each fluid port may be configured to have any shape and dimension thereof based on a manufacturer's preference. Further, the arrangement of the fluid ports 450, as depicted in FIG. 6, should not be considered as a limitation to the present disclosure.

The substrate structure 400 also includes a plurality of slots 460 configured within the intermediate layer 430 such that the at least one fluid port of the fluid ports 450 is in fluid communication with the corresponding fluid channel of the fluid channels 440. Specifically, the slots 460 provide a fluidic path/connectivity for fluids (inks) from the fluid channels 440 to the corresponding fluid ports 450. As depicted in FIG. 6, each slot of the slots 460 is configured to have the shape of a square. However, it will be evident that the each slot may be configured to have any shape and dimension thereof based on a manufacturer's preference.

Figure 7:
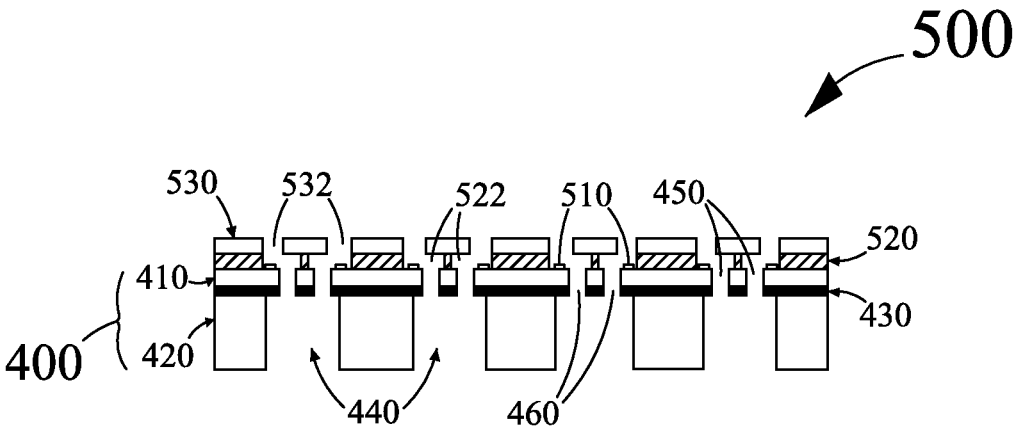
FIG. 7 depicts a partial cross-sectional view of the ejection chip utilizing the substrate structure of FIG. 6, in accordance with an embodiment of the present disclosure.

In another aspect, the present disclosure provides an ejection chip utilizing the substrate structure 400 of FIG. 6, as depicted in FIG. 7. Specifically, FIG. 7 depicts a partial cross-sectional view of an ejection chip 500 for an ejection device (printhead) of an inkjet printer.

The ejection chip 500 includes the substrate structure 400 having the first substrate layer 410, the second substrate layer 420, the intermediate layer 430, the fluid channels 440, the fluid ports 450, and the slots 460. The substrate structure 400 with respective components thereof is explained with reference to FIG. 6, and accordingly, a description thereof is herein avoided for the sake of brevity.

Further, the ejection chip 500 includes at least one fluid ejection element carried by the substrate structure 400 and adapted to eject a fluid therefrom. Specifically, the ejection chip 500 includes a plurality of fluid ejection elements 510. The fluid ejection elements 510 may be suitable resistor elements as known in the art.

Furthermore, the ejection chip 500 includes a flow feature layer 520 configured over the substrate structure 400. The flow feature layer 520 includes a plurality of flow features 522 configured therewithin. Each flow feature of the flow features 522 is configured in fluid communication with at least one corresponding fluid port of the fluid ports 450 of the first substrate layer 410. In the present embodiment, the each flow feature of the flow features 522 is configured in fluid communication with a single corresponding fluid port of the fluid ports 450. The flow feature layer 520 may be any suitable flow feature layer as known in the art.

Moreover, the ejection chip 500 includes a nozzle plate 530 configured over the flow feature layer 520. The nozzle plate 530 includes a plurality of nozzles 532 configured therewithin. Each nozzle of the nozzles 532 is configured in fluid communication with at least one corresponding flow feature of the flow features 522 of the flow feature layer 520. In the present embodiment, the each nozzle of the nozzles 532 is configured in fluid communication with a single corresponding flow feature of the flow features 522. The nozzle plate 530 may be any suitable nozzle plate as known in the art.

Based on the foregoing, the ejection chip 500 is a narrow ejection chip with optimal dimensions due to the specific dimensions of the substrate structure 400.

Figure 8:
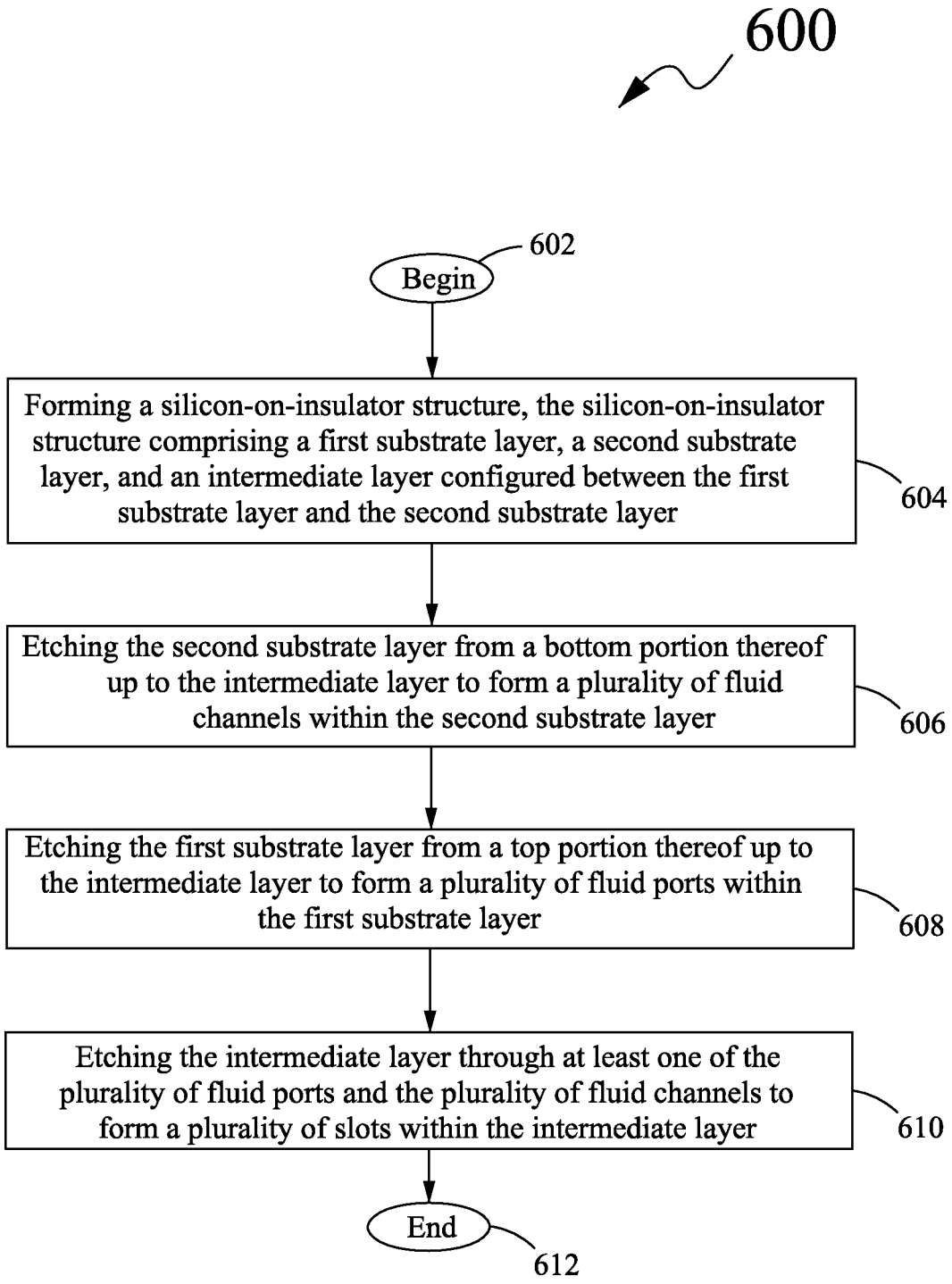
FIG. 8 depicts a flow diagram illustrating a method for fabrication of the substrate structure of FIG. 6, in accordance with an embodiment of the present disclosure.

In yet another aspect, the present disclosure provides a method for fabrication of the substrate structure 400 of FIG. 6. FIG. 8 depicts a flow diagram illustrating a method 600 for fabrication of the substrate structure 400. The method 600 is explained in conjunction with FIGS. 9-11 that depict a process flow for fabrication of the substrate structure 400. Further, reference will be made to the substrate structure 400, and the ejection chip 500, and components thereof as depicted in FIGS. 6 and 7.

Figure 9:
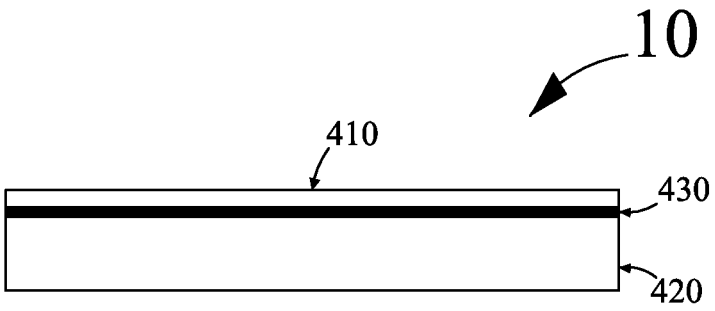
FIGS. 9-11 depict a process flow for fabrication of the substrate structure of FIG. 6 using the method of FIG. 8.

The method 600 begins at 602. At 604, a silicon-on-insulator (SOI) structure (wafer) 10 is formed, as depicted in FIG. 9. The SOI structure 10 includes a first substrate layer, such as the first substrate layer 410; a second substrate layer, such as the second substrate layer 420, disposed beneath the first substrate layer 410; and an intermediate layer, such as the intermediate layer 430, configured between the first substrate layer 410 and the second substrate layer 420. As mentioned above, the intermediate layer 430 is an insulating layer. It will be evident that the SOI structure 10 may be formed using any method known in the art for fabricating such silicon-on-insulator structures.

Figure 10:
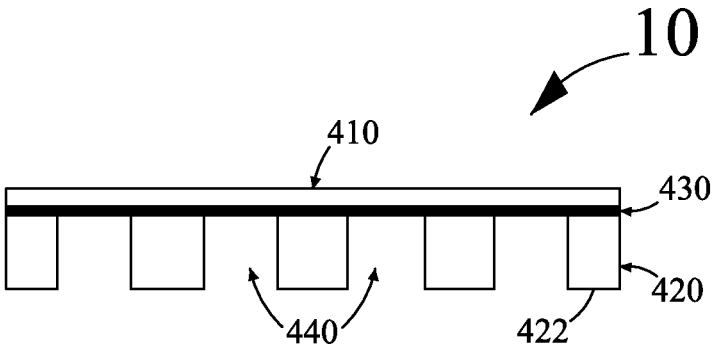

At 606, the second substrate layer 420 is etched from a bottom portion 422 thereof up to the intermediate layer 430 to form a plurality of fluid channels, such as the fluid channels 440, within the second substrate layer 420, as depicted in FIG. 10. Further, the second substrate layer 420 is etched by deep reactive ion etching (DRIE) technique, and particularly, a low frequency (such as a 33 kilo Hertz) DRIE technique. Specifically, the DRIE etching process proceeds from the bottom portion 422 (handle side) and terminates at the buried intermediate layer 430 (silicon oxide layer), as DRIE selectivity of silicon over silicon oxide is approximately 100:1. Such a technique assists in forming uniformly deep fluid channels 440 due to the presence of the intermediate layer 430.

Figure 11:
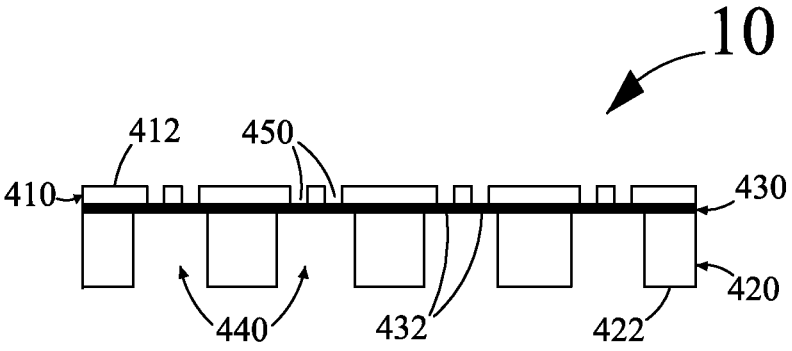

At 608, the first substrate layer 410 is etched from a top portion 412 thereof up to the intermediate layer 430 to form a plurality of fluid ports, such as the fluid ports 450, within the first substrate layer 410, as depicted in FIG. 11. Further, the fluid ports 450 are formed within the first substrate layer 410 such that the at least one fluid port of the fluid ports 450 is configured in alignment with the corresponding fluid channel of the fluid channels 440. Also, the first substrate layer 410 is etched by DRIE technique, and more particularly, a low frequency (such as a 33 kilo Hertz) DRIE technique. Specifically, the first substrate layer 410 is DRIE etched from the top portion 412 up to the buried intermediate layer 430 (based on the aforementioned DRIE selectivity of silicon over silicon oxide), in order to form the fluid ports 450 with uniform depth across the substrate structure 400 while fluidly coupling to all firing chambers (not shown). More specifically, the uniform thickness of the first substrate layer 410, i.e., device layer, and the presence of the intermediate layer 430 assist in formation of the fluid ports 450 with uniform depth. Accordingly, the intermediate layer 430 serves as an etch stop layer during etching of the first substrate layer 410 and the second substrate layer 420.

At 610, the intermediate layer 430 is etched through at least one of the fluid ports 450 and the fluid channels 440 to form a plurality of slots, such as the slots 460, within the intermediate layer 430, as depicted in FIG. 6. The slots 460 are configured within the intermediate layer 430 such that the at least one fluid port of the fluid ports 450 is in fluid communication with the corresponding fluid channel of the fluid channels 440. Further, the intermediate layer 430 is etched by one of plasma reactive ion etching (Tetrafluoromethane, $CF_4$, plasma etching) technique and wet chemical etching (buffered oxide etching) technique. Specifically, a plurality of exposed buried diaphragm regions (oxide regions) 432 (as depicted in FIG. 11) may be removed by one of the aforementioned etching techniques to physically connect the fluid ports 450 with the corresponding fluid channels 440, as depicted in FIG. 6.

The method 600 also includes forming a drive circuitry layer (not shown) on the substrate structure 400 prior to etching at least one of the first substrate layer 410 and the second substrate layer 420. Specifically, the drive circuitry layer may be formed prior to etching the first substrate layer 410. Further, the drive circuitry layer may be formed by complementary metal-oxide-semiconductor (CMOS) fabrication technique. Additionally, the method 600 includes fabricating at least one fluid ejection element, such as the fluid ejection elements 510, on the substrate structure 400. Each fluid ejection element of the fluid ejection elements 510 is electrically coupled to the drive circuitry layer. The method 600 ends at 612.

When using the SOI structure 10 for fabricating an ejection chip, such as the ejection chip 500, the first substrate layer 410 may be etched either prior to or after polymer flow feature patterning (i.e., fabrication and patterning of a flow feature layer, such as the flow feature layer 520). The flow feature patterning process requires a flat solid surface without any significant topographical feature, and such a requirement is efficiently satisfied when the first substrate layer 410 is etched after the polymer flow feature patterning. However, a sacrificial filler may be used to fill the fluid ports 450 for a uniform coating of the flow feature polymer when the first substrate layer 410 is etched prior to the polymer flow feature patterning. Suitable examples of the sacrificial filler include, but are not limited to, silicon oxide filled by Chemical Vapor Deposition technique/Physical Vapor Deposition technique; a thermally decomposable polymer; a spin-on glass material; a water soluble polymer; a fluorocarbon polymer; and the like.

Based on the foregoing, the present disclosure provides an efficient and effective substrate structure (such as the substrate structure 400); an ejection chip (such as the ejection chip 500); and a method (such as the method 600) for fabricating the substrate structure 400 that provide a uniform thickness of a top membrane (i.e., the first substrate layer 410) above all fluid channels (i.e., the fluid channels 440) across a whole wafer (i.e., the substrate structure 400). By virtue of the aforementioned arrangement, all firing chambers have a fluid port (from the fluid ports 450) with identical fluidic resistance that increases with fluidic path length.

Specifically, the use of an SOI structure (such as the SOI structure 10) assists in achieving a uniform thickness (such as thickness of about 30 μm) of the top membrane (i.e., the first substrate layer 410) with good uniformity of flow resistance of the fluid ports to firing chambers across the substrate structure.

In addition, by virtue of the present disclosure, footing effect (undercut etching at the silicon/oxide interface) of DRIE technique may easily be controlled to guarantee no reduction of sealing space between the fluid channels. Further, the footing effect is greatly reduced by using the low frequency (such as a 33 kilo Hertz) DRIE technique instead of standard high frequency Radio Frequency etching technique. Moreover, a DRIE process stopped on a silicon-based structure/wafer has a curved etching front due to plasma loading effect. However, such a curved etching front may easily be flattened out using the etch stop layer (i.e., the intermediate layer 430) of silicon oxide of the present disclosure while eliminating the requirement of any sacrificial fillers in the fluid ports.

The foregoing description of several embodiments of the present disclosure has been presented for purposes of illustration. It is not intended to be exhaustive or to limit the disclosure to the precise forms disclosed, and obviously many modifications and variations are possible in light of the above teaching. It is intended that the scope of the disclosure be defined by the claims appended hereto.

The invention claimed is:

1. A substrate structure for an ejection chip, the substrate structure comprising:

a first substrate layer;

a second substrate layer disposed beneath the first substrate layer;

an intermediate layer configured between the first substrate layer and the second substrate layer, wherein the intermediate layer is an insulating layer and the first substrate layer, second substrate layer, and intermediate layer together form a silicon-on-insulator structure;

a plurality of fluid channels configured within the second substrate layer;

a plurality of fluid ports configured within the first substrate layer, at least one fluid port of the plurality of fluid ports being configured in alignment with a corresponding fluid channel of the plurality of fluid channels; and a plurality of slots configured within the intermediate layer such that the at least one fluid port of the plurality of fluid ports is in fluid communication with the corresponding fluid channel of the plurality of fluid channels.

2. The substrate structure of claim 1, wherein the intermediate layer is composed of silicon oxide.

3. The substrate structure of claim 1, wherein the first substrate layer has a thickness ranging from about 10 microns (μm) to about 80 μm.

4. The substrate structure of claim 1, wherein the second substrate layer has a thickness ranging from about 100 μm to about 800 μm.

5. The substrate structure of claim 1, wherein the intermediate layer has a thickness ranging from about 0.5 μm to about 5 μm.

6. The ejection chip of claim 1, further including a sacrificial layer in the fluid ports for uniform coating before flow feature patterning.

7. An ejection chip for an inkjet printer, the ejection chip comprising:

a substrate structure comprising, a first substrate layer, a second substrate layer disposed beneath the first substrate layer, an intermediate layer configured between the first substrate layer and the second substrate layer, wherein the intermediate layer is an insulating layer and the first substrate layer, second substrate layer, and intermediate layer together form a silicon-on-insulator structure, a plurality of fluid channels configured within the second substrate layer, a plurality of fluid ports configured within the first substrate layer, at least one fluid port of the plurality of fluid ports being configured in alignment with a corresponding fluid channel of the plurality of fluid channels, and a plurality of slots configured within the intermediate layer such that the at least one fluid port of the plurality of fluid ports is in fluid communication with the corresponding fluid channel of the plurality of fluid channels;

at least one fluid ejection element carried by the substrate structure and adapted to eject a fluid therefrom;

a flow feature layer configured over the substrate structure, the flow feature layer comprising a plurality of flow features, each flow feature of the plurality of flow features being configured in fluid communication with at least one corresponding fluid port of the plurality of fluid ports of the first substrate layer; and a nozzle plate configured over the flow feature layer, the nozzle plate comprising a plurality of nozzles, each nozzle of the plurality of nozzles being configured in fluid communication with at least one corresponding flow feature of the plurality of flow features of the flow feature layer.

8. The ejection chip of claim 7, wherein the intermediate layer is composed of silicon oxide.

* * * * *